US006260772B1

(12) United States Patent
Hennemann, Jr. et al.

(10) Patent No.: US 6,260,772 B1
(45) Date of Patent: Jul. 17, 2001

(54) DISPENSING AND RINSING GUN

(75) Inventors: Thomas L. Hennemann, Jr., Winston-Salem, NC (US); Eddie D. Sowle, Woodbury, MN (US); Roberto Inchaustequi, Summerfield; Vincent C. Patrignani, Greensboro, both of NC (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/691,007

(22) Filed: Oct. 18, 2000

Related U.S. Application Data

(60) Provisional application No. 60/211,381, filed on Jun. 14, 2000.

(51) Int. Cl.[7] ..... A62C 5/02

(52) U.S. Cl. ..... 239/310; 239/312; 239/526

(58) Field of Search ..... 239/310, 312, 239/318, 375, 525, 526, 398, 433, 434, 436, 442, 443, 444, 146; 134/123, 172

(56) References Cited

U.S. PATENT DOCUMENTS

| | | | | |
|---|---|---|---|---|
| 5,405,086 | * | 4/1995 | Kranzle | 239/310 |
| 5,419,495 | * | 5/1995 | Berfield | 239/310 |
| 6,068,204 | * | 5/2000 | Alexander | 239/310 |

* cited by examiner

*Primary Examiner*—Lisa Ann Douglas
(74) *Attorney, Agent, or Firm*—Mau & Krull, P.A.

(57) ABSTRACT

The present device relates to a dispensing and rinsing gun (100) for use with a hose member (209 and 210) to dispense either a diluted product or water through the same dispensing and rinsing gun (100) without having to attach different nozzles. A selector (156) operatively connected to the gun (100) allows the gun (100) to dispense either a diluted product or water by rotating the selector (156) to the appropriate push button valve (154) controlling the desired product or water, and the selector (156) may be operated with one hand. A trigger (103) controls the type of spray used when the dispensing and rinsing gun (100) is used in the water rinse mode.

16 Claims, 8 Drawing Sheets

DISPENSING AND RINSING GUN

This appln claims benefit of prov. No. 60/211,381 filed Jun. 14, 2000.

BACKGROUND OF THE INVENTION

1. Field of the Invention

The present invention relates to a dispensing and rinsing gun for use with a liquid diluent and a liquid concentrate.

2. Description of the Prior Art

Dispensing and rinsing guns are commonly used in the food service industry, and are used for washing, rinsing, and sanitizing items such as processing equipment, floors, walls, and table tops.

Most dispensing and rinsing guns require the product to be switched on and off at a remote station, and they require that the liquid diluent/liquid concentrate solution run through the outlet hose. Previous wall mounted or remote mounted devices require a time delay to purge the first product out when switching to the second product to ensure there is no contamination of the outlet hose with the other product. With these devices, additional outlet hoses could be attached to the units in order to provide greater mobility of the devices. However, with the longer outlet hoses, the back pressure of the devices are increased and this reduces or eliminates the dispensing ability. Also, some previous devices do not provide a rinse mode for a water only dispensing mode and may require electricity to trigger an electric pump at the water and product reservoir.

Previous devices that use a single dispensing hose require two or three different dispensing nozzles for various products. These nozzles provide fan spray and foaming action, and they also provide a method of regulating the flow during the rinsing operation. With these devices, it is possible to lose the nozzles or utilize the wrong nozzle for the particular product.

The present invention allows water and product to be dispensed from one gun without purging the outlet hose before using different dispensing modes of the gun and without electricity. The gun may be turned on and off from the gun itself rather than at a remote location.

SUMMARY OF THE INVENTION

A preferred embodiment dispensing gun for dispensing water received from a water supply and for dispensing a product diluted in the dispensing gun with water received from the water supply includes a handle, a water inlet, a water outlet, and a hose receiving member. A hose member includes a first channel and a second channel. The hose receiving member is operatively connected to a first channel of a hose member, and the first channel is in fluid communication with the water inlet. An aspirator is operatively connected to the second channel of the hose member and is in fluid communication with the water outlet. The aspirator includes an outlet. A water supply supplies the gun with water via the first channel of the hose member, and a product supply supplies the gun with product via the second channel of the hose member, wherein the aspirator creates a use solution of product diluted with water for the water outlet. The use solution exits the outlet of the aspirator. A nozzle is operatively connected to the water outlet to dispense water from the water outlet. A first valve is in fluid communication with the water outlet and the nozzle, and a second valve is in fluid communication with the water outlet and the aspirator. The first valve controls the flow of water via the first channel and the second valve controls the flow of water via the first channel through the aspirator. The first valve allows water to flow from said water outlet through the nozzle, and the second valve allows water to flow from the water outlet into the aspirator and the use solution created therein to flow through the outlet of the aspirator.

In another preferred embodiment, an apparatus for dispensing liquid diluent and a liquid concentrate diluted with diluent includes a dispenser having an inlet and an outlet. A hose member includes a first channel and a second channel. The first channel interconnects a liquid diluent source to the inlet, wherein liquid diluent flows from the liquid diluent source into the inlet and out of the outlet. An aspirator is operatively connected to the outlet via the second channel. The aspirator includes a liquid diluent inlet a liquid concentrate inlet, and a dilute solution outlet. A control device operatively connected to the aspirator controls the flow of liquid diluent from a source of liquid diluent to the liquid diluent inlet. A nozzle is operatively connected to the outlet for dispensing liquid diluent from the outlet. A first valve is in fluid communication with the outlet and the nozzle and controls the flow of liquid diluent out of the nozzle. A second valve is in fluid communication with the outlet and the aspirator and controls the flow of dilute solution out of the dilute solution outlet.

In another preferred embodiment dispensing gun for dispensing water received from a water supply and for dispensing a product diluted in the dispensing gun with water received from the water supply, the dispensing gun includes a handle, a water inlet, a water outlet, and a hose receiving member operatively connected to a first channel of a hose member. The first channel of the hose member is in fluid communication with the water inlet. An aspirator is in fluid communication with the water outlet, and the aspirator includes an outlet. A water supply supplies the dispensing gun with water via the first channel of the hose member. A product supply is in fluid communication with the aspirator, wherein the aspirator creates a use solution of product diluted with water from the water outlet, and the use solution exits the outlet of the aspirator. A first nozzle is operatively connected to the water outlet to dispense water from the water outlet; and a first valve is in fluid communication with the water outlet and the first nozzle, and a second valve is in fluid communication with the water outlet and the aspirator. The first valve controls the flow of water via the first channel and the second valve controls the flow of water via the first channel through the aspirator. The first valve allows water to flow from the water outlet through the first nozzle and the second valve allows water to flow from the water outlet into the aspirator and the use solution created therein to flow through the outlet of the aspirator.

DETAILED DESCRIPTION OF THE PREFERRED EMBODIMENT

A preferred embodiment dispensing and rinsing gun constructed according to the principles of the present invention is designated by the numeral 100 in FIGS. 1–6 and 8.

Figure 1:
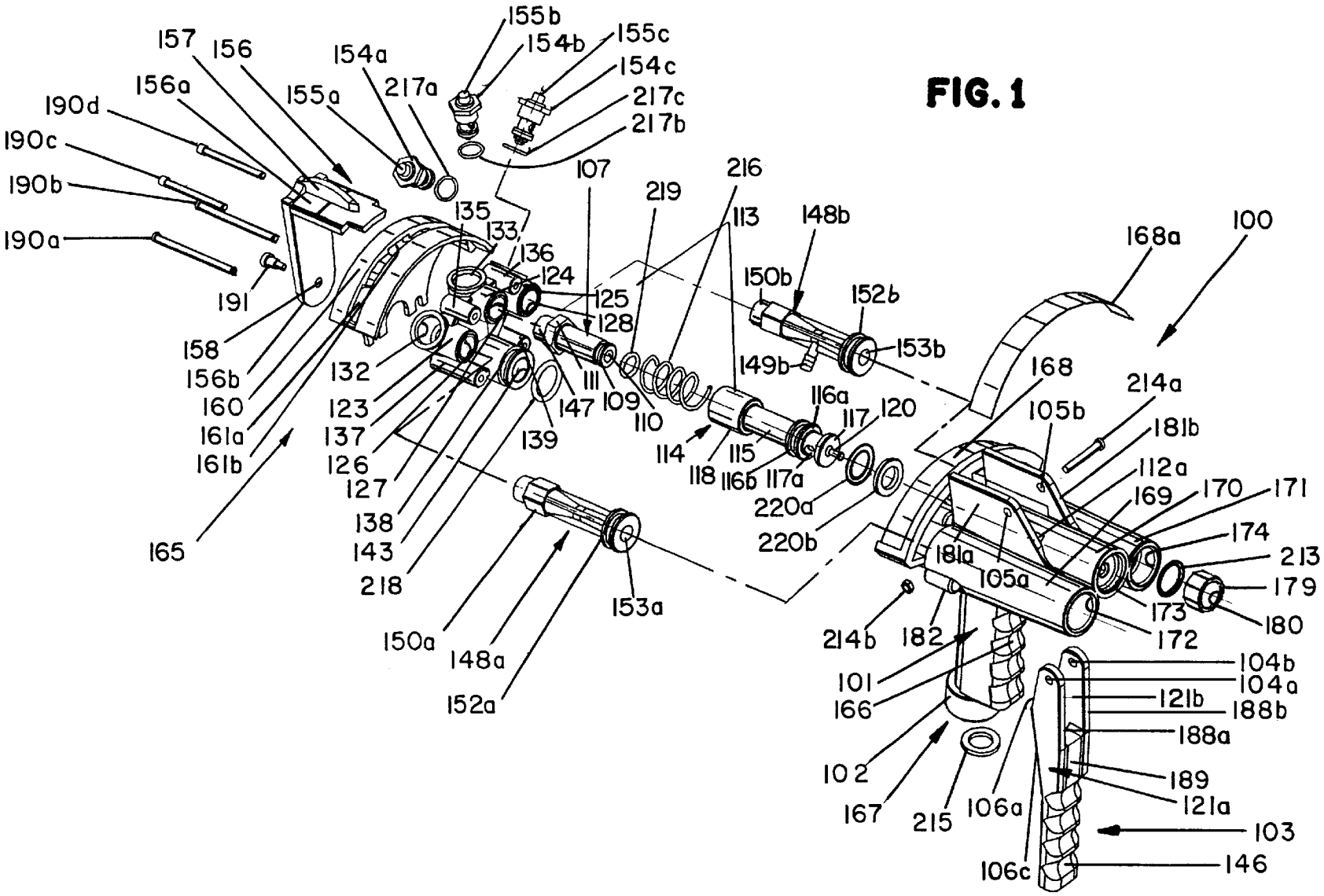
FIG. 1 is an exploded perspective view generally viewed from the front of a dispensing and rinsing gun.
Figure 2:
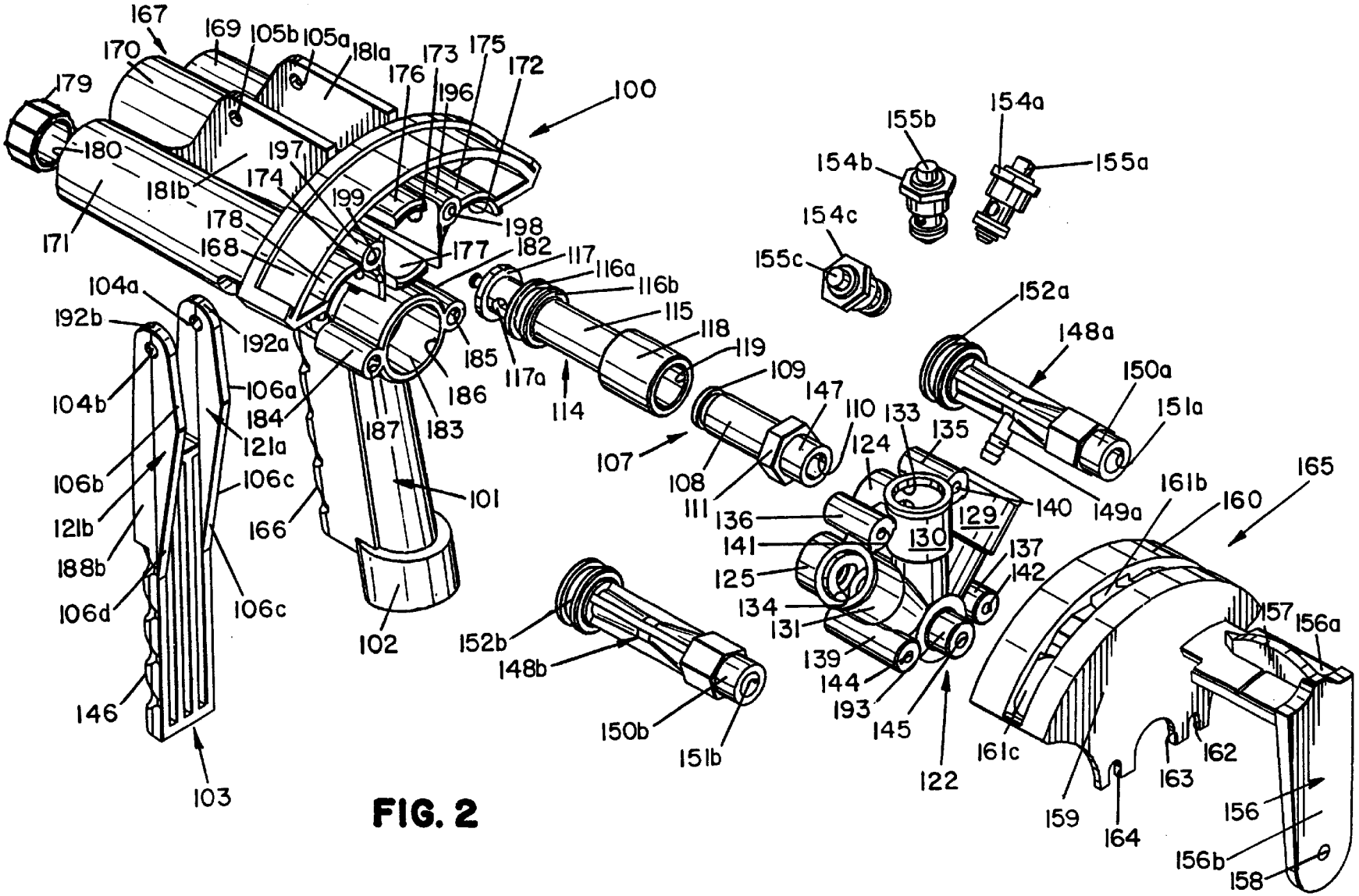
FIG. 2 is an exploded perspective view generally viewed from the rear of the dispensing and rinsing gun in FIG. 1.
Figure 3:
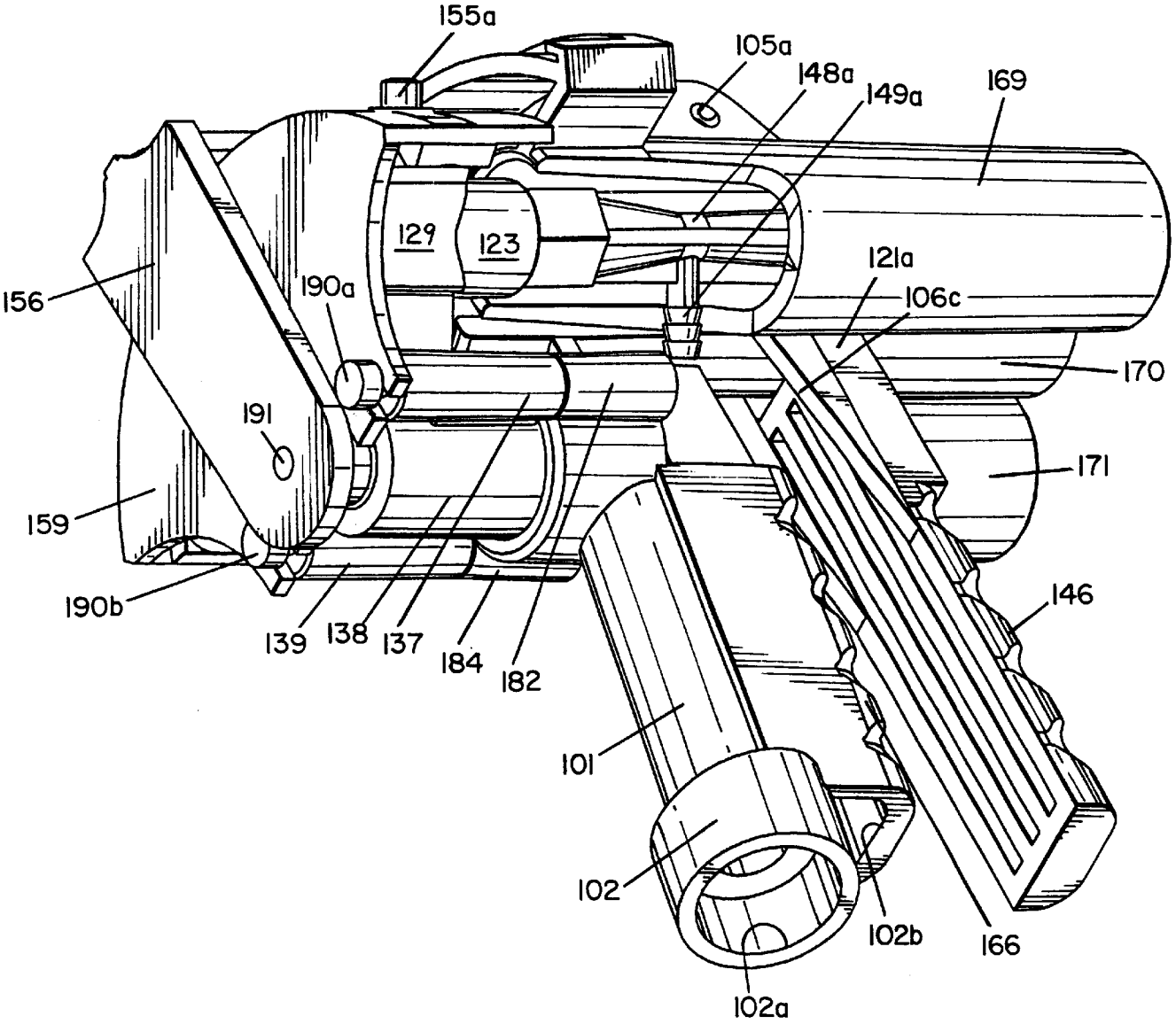
FIG. 3 is a perspective view generally viewed from the rear of the dispensing and rinsing gun in FIG. 1.
Figure 4:
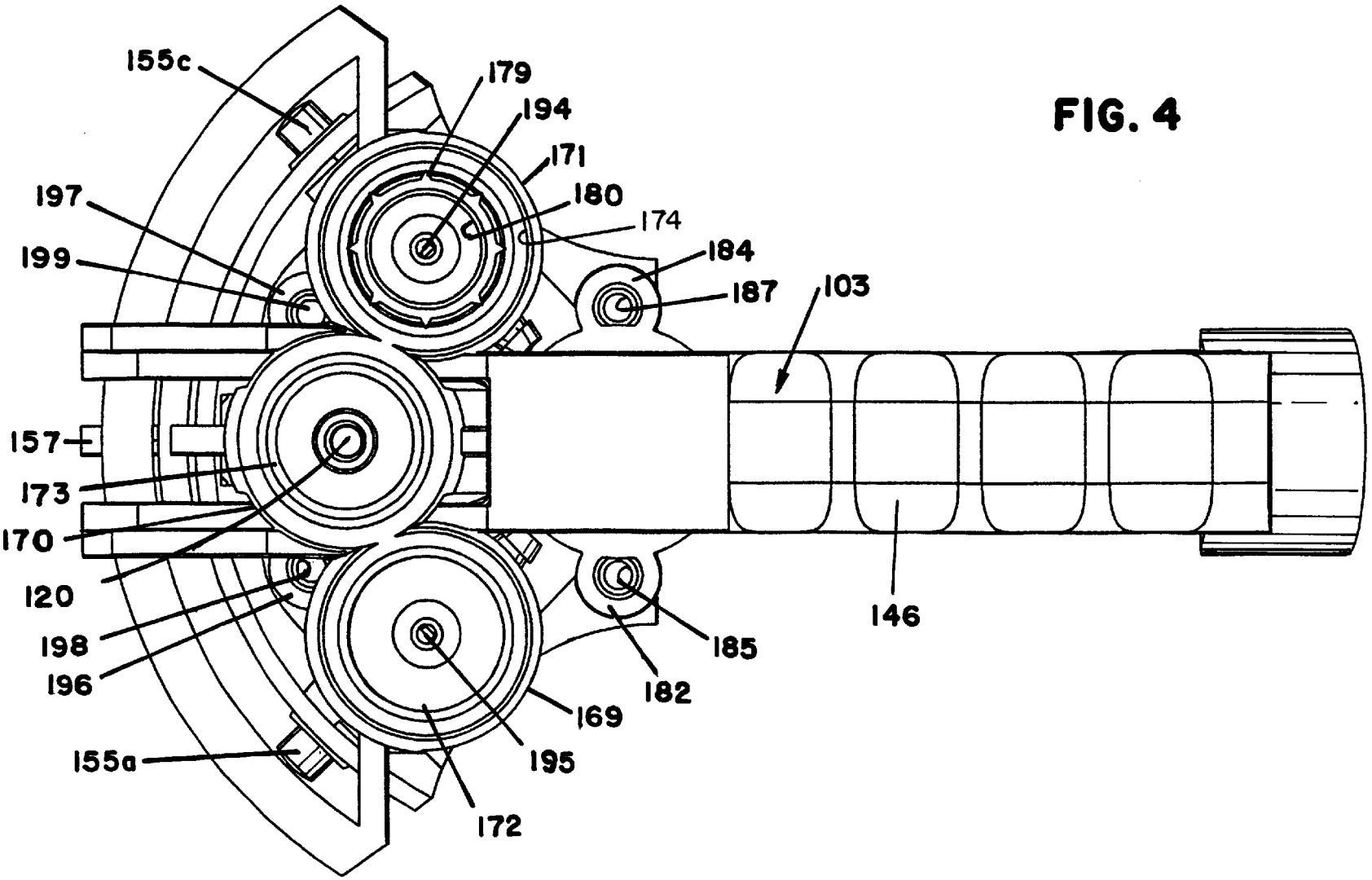
FIG. 4 is a front view of the dispensing and rinsing gun in FIG. 1.
Figure 5:
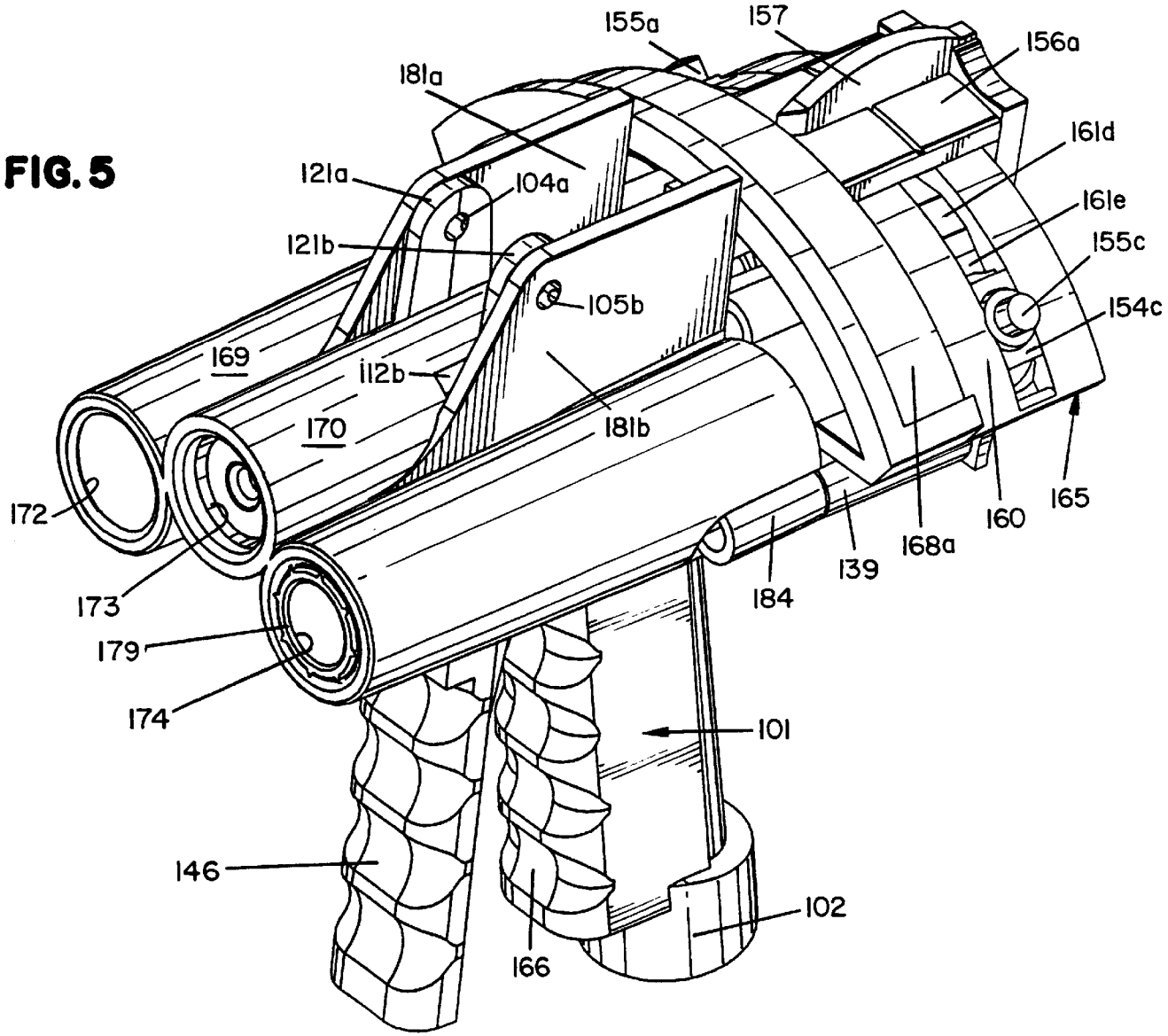
FIG. 5 is a perspective view generally viewed from the front of the dispensing and rinsing gun in FIG. 1.

FIGS. 1 and 2 show dispensing and rinsing gun 100 in exploded perspective views generally viewed from the front and from the rear, respectively, to show how the various components are constructed and arranged to form dispensing and rinsing gun 100. FIGS. 3–5 show dispensing and rinsing gun 100 in various views to further assist in showing how the various components fit together. First, how these components interconnect will be described, and then how water or liquid diluent flows through the components will be described.

Housing unit 167 is constructed and arranged to accommodate the components of dispensing and rinsing gun 100. Housing unit 167 includes first tube 169, second tube 170, and third tube 171. In the preferred embodiment, first tube 169 is used for dispensing sanitizing spray through first cavity 172, second tube 170 is used for dispensing water through second cavity 173, and third tube 171 is used for dispensing foam degreaser through third cavity 174. At the end of first tube 169, first tube includes a spray nozzle 195 for dispensing product in a fan spray. At the end of the second tube 170, second tube 170 includes a pistol 117 for dispensing water in a variable spray. At the end of third tube 171, third tube includes a spray nozzle 194 and a foam member 179 having an aperture 180 to accommodate a screen 213 for dispensing a foaming product. Spray nozzles 194 and 195 are of the type well known in the art. In the preferred embodiment, the spray nozzle 194 for use with a foam degreaser is Spraying Systems model number H1/4DU8070 and the spray nozzle 195 for use with a sanitizing spray is Spraying Systems model number H1/4U1550. First tube 169 and third tube 171 are in alignment along the same plane, and second tube 170 is positioned between and is in contact on each side with first tube 169 and third tube 171 slightly above the plane. Proximate the rear and the center of second tube 170 is a first wall 181*a* extending from and operatively connected to one side of second tube 170 and a second wall 181*b* extending from and operatively connected to the opposite side of second tube 170 parallel to first wall 181*a*. Walls 181*a* and 181*b* appear as partial dividers between the tubes 169, 170 and 171. First wall 181*a* includes aperture 105*a* proximate the top of first wall 181*a* near the end proximate the center of second tube 170. Second wall 181*b* includes aperture 105*b* proximate the top of second wall 181*b* near the end proximate the center of second tube 170. Adjacent and proximate the inner surfaces of walls 181*a* and 181*b*, there are slots 112*a* and 112*b* in second tube 170, respectively, constructed and arranged to accept first prong 121*a* and second prong 121*b* of trigger 103. First prong 121*a* and second prong 121*b* extend from a grip 146 having a front surface 189 proximate the prongs 121*a* and 121*b*. Grip 146 has a surface contoured to aid in gripping trigger 103 with one's fingers. The contoured surface helps prevent trigger 103 from slipping away from one's hand during use and also aids in comfort during use of trigger 103.

First prong 121*a* and second prong 121*b* include front edges 188*a* and 188*b* that interconnect the front of prongs 121*a* and 121*b* and front surface 189 of grip 146. Rounded top portions 192*a* and 192*b* interconnect front edges 188*a* and 188*b* and back edges 106*a* and 106*b*, and then slanted edges 106*c* and 106*d* interconnect the back edges 106*a* and 106*b* and the back of grip 146. Trigger 103 includes aperture 104*a* proximate the top of first prong 121*a* and aperture 104*b* proximate the top of second prong 121*b*. Apertures 104*a* and 104*b* of trigger 103 are constructed and arranged to align with apertures 105*a* and 105*b* of walls 181*a* and 181*b* when prongs 121*a* and 121*b* are inserted through slots 112*a* and 112*b*, respectively. Trigger 103 may be fastened to housing unit 167 by inserting a fastening member known in the art through the respective apertures, and apertures 105*a* and 105*b* serve as a pivot point for trigger 103 when it is pulled toward handle 101. In the preferred embodiment, bolt 214*a* and nut 214*b* fasten trigger 103 to housing unit 167.

Ledge 168 is a curved structure proximate the back end of housing unit 167 and includes a plurality of support members constructed and arranged in a curved fashion to accommodate the rounded shapes of aspirators 148*a* and 148*b* and pistol nozzle 113. First support member 175 aligns with the top of first tube 169, second support member 176 aligns with the top of second tube 170, third support member 177 aligns with the bottom of second tube 170, and fourth support member 178 aligns with the top of third tube 171. First support member 175 provides support for the component inserted into first cavity 172 of first tube 169, second support member 176 and third support member 177 provide support for the component inserted into second cavity 173 of second tube 170, and fourth support member 178 provides support for the component inserted into third cavity 174 of third tube 171. Between first support member 175 and second support member 175 is a tube 196 having a bore 198 and between second support member 175 and fourth support member 178 is a tube 197 having a bore 199 for securing housing unit 167 to other components with fastening members such as screws. It is understood however that other fastening means known in the art may be used to fasten housing unit 167. Below third support member 177 is thirteenth tube 183 including water outlet 186. On one side of thirteenth tube 183 is twelfth tube 182 including twelfth bore 185 and on the other side of thirteenth tube 183 is fourteenth tube 184 including fourteenth bore 187. Twelfth tube 182 and fourteenth tube 184 also secure housing unit 167 to other components with fastening members known in the art.

Handle 101 includes a grip 166 and a hose receiving member 102 having a water inlet 102*a* and a product inlet 102*b*. In the preferred embodiment, a tri-extruded hose is utilized to transport water and product simultaneously without contaminating the hose member. A first channel of the hose member is used for water or liquid diluent, a second channel of the hose member is used for product or liquid concentrate, and a third channel of the hose member is used for another product or liquid concentrate. Therefore, the first channel is in fluid communication with water inlet 102*a*, and the second channel and the third channel run through product inlet 102*b* to operatively connect to product inlet ports 149*a* and 149*b*, respectively, of aspirators 148*a* and 148*b*. Water inlet 102*a* is in fluid communication with water outlet 186. The preferred embodiment water inlet 102*a* includes a threaded inner surface and a ring 215 for securely connecting a threaded end of the first channel 210*a* of the hose member 210 thereto.

Housing 122 is another component of gun 100. Housing 122 includes a plurality of tube members having longitudinal bores formed therein. First tube 123 having first bore 126, second tube 124 having second bore 127, and third tube 125 having third bore 128 are constructed and arranged to be in fluid communication with first tube 169 having first cavity 172, second tube 170 having second cavity 173, and third tube 171 having third cavity 174, respectively. Perpendicular to but in fluid communication with tubes 123, 124 and 125 opposite the ends communicating with the components of housing unit 167 are fourth tube 129 having fourth bore 132, fifth tube 130 having fifth bore 133, and sixth tube 131 having sixth bore 134. Aligned with tubes 196 and 197 are tubes 135 and 136 having bores 140 and 141, respectively, to fasten housing 122 to housing unit 167. Screw 190*c* is inserted through bores 140 and 198 and screw 190*d* is inserted through bores 141 and 199. Below second tube 124 is tenth tube 138 having tenth bore 143, which is in fluid communication with thirteenth tube 183, the water outlet. An O-ring 218 prevents water leakage from tenth tube 138. Tenth tube 138 allows water to flow into tubes 123, 124 and 125, and opposite tenth tube 138 is tube 193 having screw hole 145. Tubes 137 and 139 align with tubes 182 and 183 to fasten housing 122 to housing unit 167. Screw 190*a* is inserted through bores 142 and 185 and screw 190*b* is inserted through bores 144 and 187. On one side of tenth tube 138 is ninth tube 137 having ninth ore 142, and on the opposite side of tenth tube 138 is eleventh tube 139 having eleventh bore 144. Tubes 137 and 139 also provide means for fastening housing 122 to housing unit 167.

Valves 154*a,* 154*b* and 154*c* include push buttons 155*a,* 155*b* and 155*c* and are push button valves well known in the art. It is also recognized that other valve arrangements known in the art besides push button valves may be used. One such valve arrangement that could be used is a slide valve. In the preferred embodiment, Quest Engineering model number P400K-591 valves are used. O-rings 217*a,* 217*b,* and 217*c* prevent water leakage from valves 154*a,* 154*b,* and 154*c,* respectively. When the push button of the selected valve is pressed, an opening is exposed and water is allowed to flow through the opening of the selected valve. Valves 154*a,* 154*b* and 154*c* are used for product selection when the gun 100 is in use. Valve 154*a* is inserted into fourth bore 132, valve 154*b* is inserted into fifth bore 133, and valve 154*c* is inserted into sixth bore 134 to control whether water flows through the selected bore.

Aspirators 148*a* and 148*b* commonly known in the art are inserted into first bore 126 and third bore 128, respectively, and a pistol nozzle 113 including a first segment 107 and a second segment 114 commonly known in the art is inserted into second bore 127. Aspirators 148*a* and 148*b* include a first end 150*a* and 150*b* having bores 151*a* and 151*b* that are in fluid communication with first tube 123 and third tube 125, respectively. Inlet port 149*a* is connected to first channel and inlet port 149*b* is connected to the third channel of the hose member to provide product to aspirators 148*a* and 148*b*. At the opposite end of aspirators 148*a* and 148*b* are rings 152*a* and 152*b* and bores 153*a* and 153*b*. Bore 153*a* is in fluid communication with third tube 171 and bore 153*b* is in fluid communication with first tube 169. Therefore, aspirator 148*a* is in fluid communication with first cavity 172 and aspirator 148*b* is in fluid communication with third cavity 174.

Pistol nozzle 113 is well known in the art and includes a first segment 107 and a second segment 114. First segment 107 is a water supply tube and second segment 114 is a control tube. First segment 107 includes an end 147 having a bore 110 extending through first segment 107 and in fluid communication with second tube 124. Hexshape 111 is between end 147 and shaft 108. At the opposite end proximate shaft 108 is a ring 109. Therefore, pistol nozzle 113 is in fluid communication with second cavity 173. Second segment 114 includes a shaft 115 connected at one end to an end 118 having bore 119 and connected at the opposite end to pistol 117. Between shaft 115 and pistol 117 are rings 116*a* and 116*b*. Pistol 117 includes an opening 117*a* proximate ring 116*a* and a pin 120 at the end of pistol 117. The end of first segment 107 proximate ring 109 is constructed and arranged to fit inside bore 119 of end 118 of second segment 114.

When valve 154*b* is opened, water flows through the valve 154*b,* through the first segment 107, and through second segment 114. Between first segment 107 and second segment 114 is an O-ring seal 219 to prevent water leakage. Water flows through second segment 114 and into second tube 170 through holes at the end of second segment 114, and O-ring seal 220*a* contacts ring 116*a* to prevent water leakage. In the "rinse off" mode, the second segment 114 is sealed against a seal 220*b* at the end of the second tube 170. Seal 220*b* is a washer that seals second segment 114 to a stop, which is built into the dispensing end of second tube 170, contacting pistol 117 and second cavity 173. Seal 220*b* blocks the second cavity 173 in second tube 170 and prevents water from flowing out of second tube 170. When trigger 103 is pulled, edges 106*a* and 106*b* pull second segment 114 back, which in turn pulls the pin 120 back, thereby varying the type of spray dispensed from second tube 170. Second segment 114 slides back on first segment 107, and this removes the seal 220*b* proximate the second cavity 173 of second tube 170. Water is then allowed to flow through second cavity 173. The pin 120 on the end of second segment 114 deflects the water as it leaves second tube 170 and creates the spray pattern from cone to stream. This change in spray pattern occurs by moving second segment 114 further back into second tube 170. When trigger 103 is released, a spring 216 pushes second segment 114 back to an "off" position and water flow is stopped. This mechanism is well known in the art.

Once the components discussed above are arranged together, cover 165 fits over the rear portion of housing unit 167 proximate ledge 168. Cover 165 includes a rounded t op portion 160 connected on one end to the top of back portion 159, and top portion 160 is constructed and arranged to align adjacent to ledge 168. A cover 168*a* is constructed and arranged to fit under ledge 168. Back portion 159 is generally fan shaped and includes a plurality of notches to fasten back portion 159 to housing unit 167 proximate the bottom of back portion 159. First notch 162 corresponds with ninth bore 142 and twelfth bore 185, and once the components are arranged together, a fastening member such as screw 190*a* may be inserted through the bores to fasten cover 165 to housing unit 167. Second notch 163 corresponds with screw hole 145 of tube 193, where a screw member 191 may be inserted to fasten cover 165 to housing unit 167. Third notch 164 corresponds with eleventh bore 144 and fourteenth bore 187, and once the components are arranged together, a fastening member such as screw 190*b* may be inserted through the bores to fasten cover 165 to housing unit 167. The rounded top portion 160 includes raised portions 161*d* and detents 161*e* that hold selector 156 in place during use of gun 100.

Figure 9:
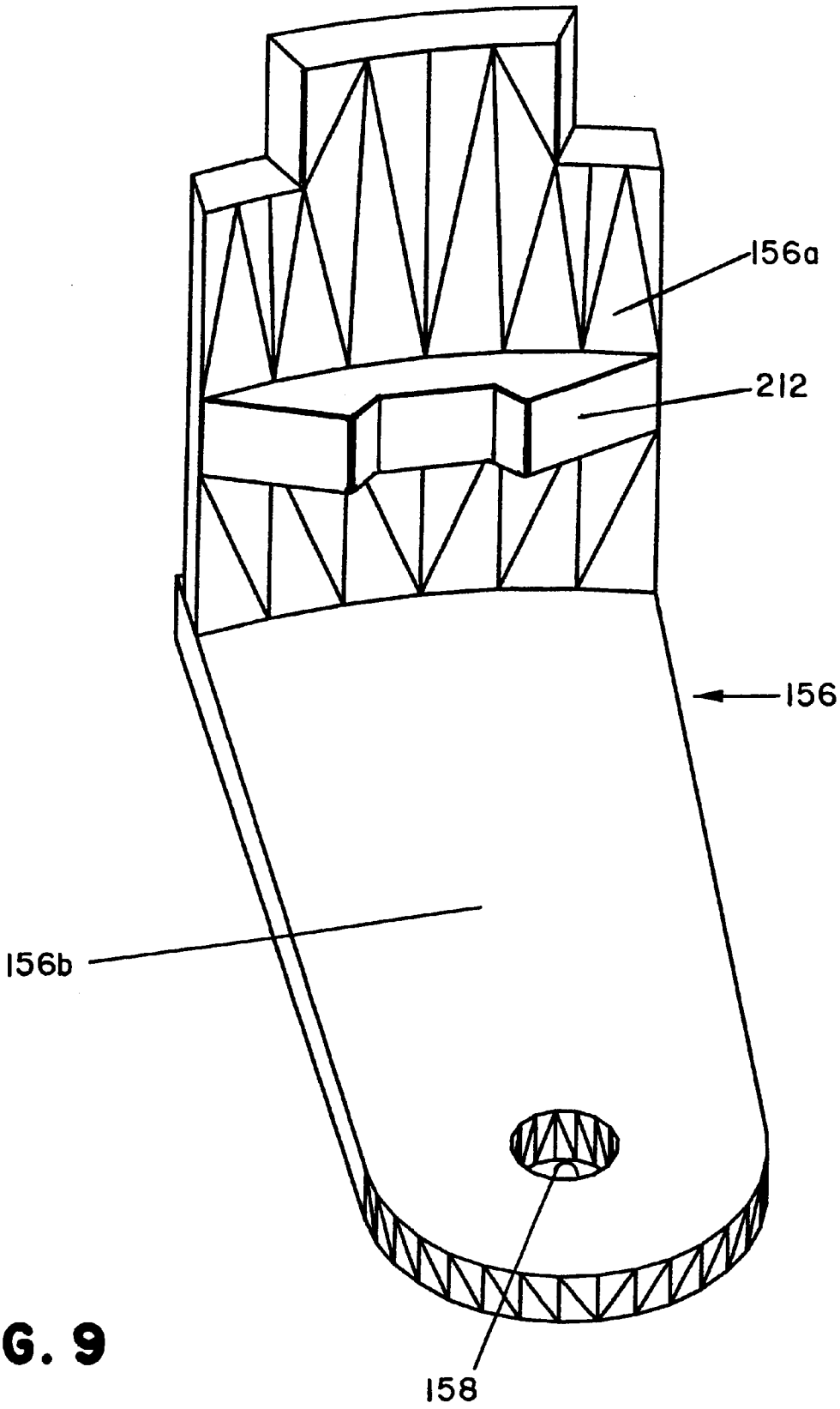
FIG. 9 is a bottom view of a selector from the dispensing and rinsing gun in FIG. 1.

Selector 156 includes a top 156*a* that is placed on top of top portion 160, which has apertures 161*a,* 161*b* and 161*c,* raised portions 161*d* and detents 161*e*. Apertures 161*a,* 161*b* and 161*c* are openings through which push button valves 154*a,* 154*b* and 154*c* extend, and raised portions 161*d* and detents 161*e* provide a surface on which selector 156 is rotated to keep selector 156 in position during use. Selector 156 also includes a bottom 156*b* that is placed against back portion 159. Top 156*a* and bottom 156*b* are connected at approximately a right angle and are generally rectangular in shape. Top 156*a* has a surface underneath including a cam 212 corresponding to the raised portions 161*d* and detents 161*e* and an indicator 157 to show which push button valve is in operation. FIG. 9 shows the underneath surface of top 156*a* including cam 212. Bottom 156*b* has an aperture 158 through which screw 191 may be placed to fasten selector 156 to screw hole 145. Screw hole 145 is therefore the pivotal point for selector 156. Selector 156 may be rotated along the top of top portion 160 to select the desired mode of the gun 100 by pushing down on the appropriate push button valve, and the raised portions 161*d* and detents 161*e* keep selector 156 in position. The end of top 156*a* slides along the bottom surface of ledge 168 and underneath cover 168*a*.

In the preferred embodiment, the selector 156 has cam 212 underneath its top surface. Cam 212 rides in the raised portions 161*d* and the detents 161*e* of cover 165. As the selector 156 moves along cover 165 to activate one of the valves, the cam 212 contacts one of the push buttons 155*a*, 155*b*, or 155*c*. The cam 212 forces the desired push button to depress and locks the selector 156 onto the push button. This opens the corresponding valve and keeps the valve open until the selector 156 is moved off of the push button. The selector 156 can be positioned between push buttons to prevent any valves from opening. This is the "off" position for the dispensing gun 100. Stops are built into the dispensing gun 100 to prevent the selector 156 from traveling outside of its intended range.

Figure 6:
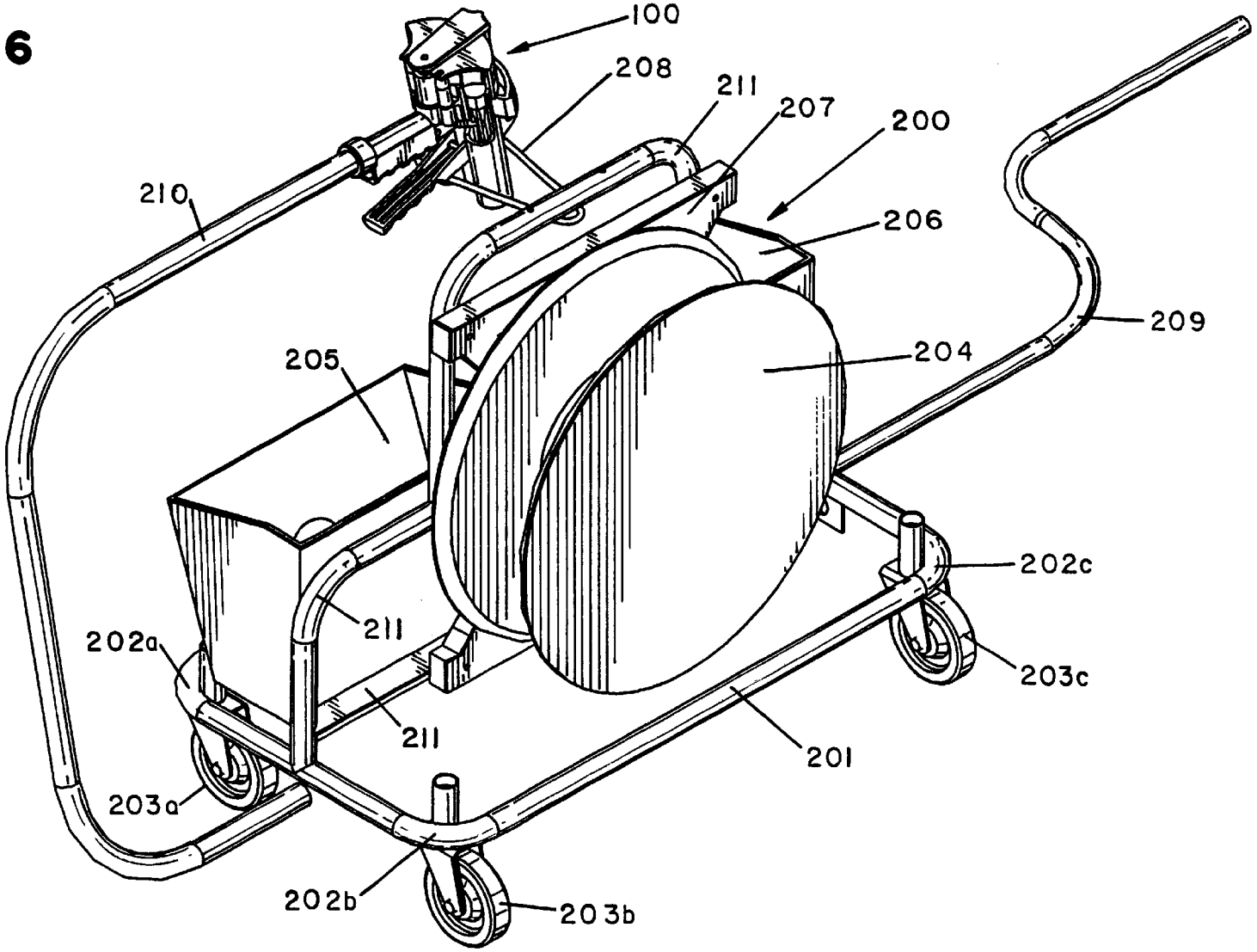
FIG. 6 is a perspective view of the dispensing and rinsing gun in FIG. 1 attached to a cart.

There are two options for using gun 100. One option is to mount gun 100 and product containers 205 and 206 on a wall and the other option is to utilize gun 100 and containers 205 and 206 with a cart 200. A long tri-extruded hose 210 approximately 50 feet or longer may be used when mounted on a wall, and the tri-extruded hose may be directly connected to the water source and to the product containers. FIG. 6 shows gun 100 attached to a cart 200. Cart 200 includes a base 201 generally rectangular in shape with corners 202*a*, 202*b*, 202*c* and 202*d*. Wheel members 203*a*, 203*b*, 203*c* and 203*d* are operatively connected to corners 202*a*, 202*b*, 202*c* and 202*d*, respectively, and enable cart 200 to be easily transported to various locations. Cart 200 may be pulled from the bottom to prevent cart 200 from tipping over due to the weight of the product containers 205 and 206, hose reel 204 and gun 100.

Figure 7:
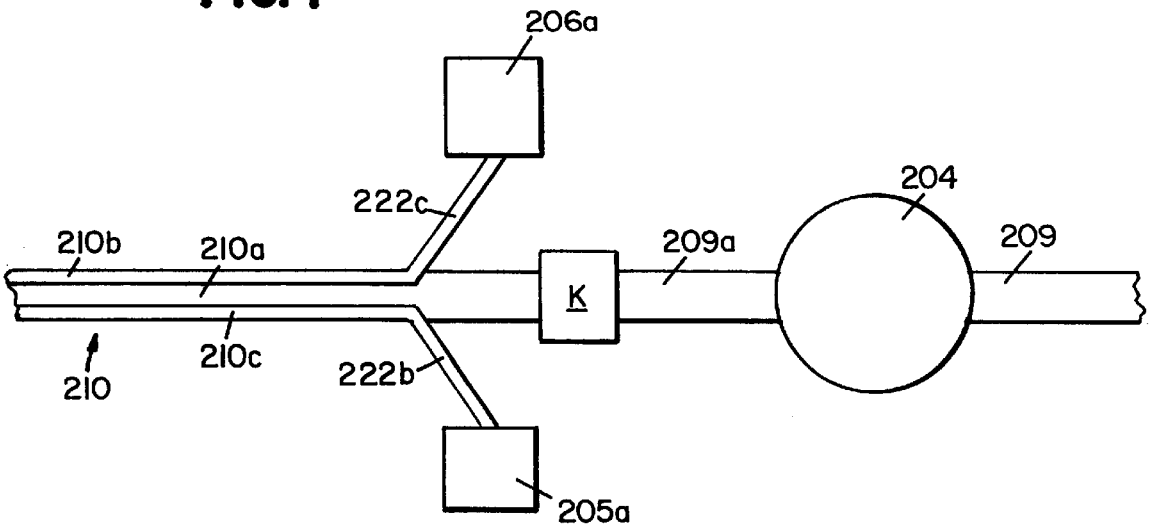
FIG. 7 is a schematic representation of a hose member connected to an extruded hose.
Figure 8:
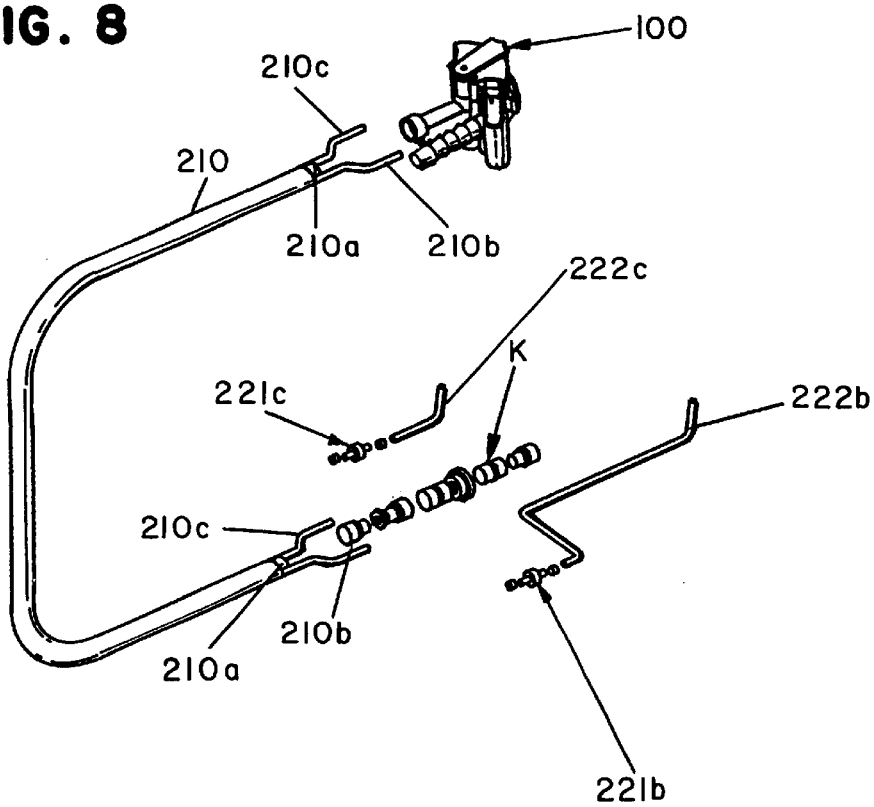
FIG. 8 is an exploded view of the extruded hose and fittings in FIG. 6.

Water hose 209 and extension hose 209*a* operatively connect to a tri-extruded hose 210 proximate product containers 205 and 206. The water hose 209 and the tri-extruded hose 210 are connected using a standard hose to hose connector known in the art. Tri-extruded hose 210 includes a first channel 210*a*, a second channel 210*b*, and a third channel 210*c*. Channels 210*b* and 210*c* including check valves run from product contained in each product container 205 and 206 and merge with extension hose 209*a* including a coupler such as a hose fitting K to form tri-extruded hose 210. The product containers 205 and 206 are generally rectangular shaped boxes with an open top and are mounted to a railing 211 using nuts and bolts, and the tri-extruded supply hose 210 is operatively connected at one end to the railing 211 and at the other end to the gun 100. Flexible product bags 205*a* and 206*a* containing product are placed in the product containers 205 and 206, respectively. It is also recognized that cartons, bottles, jugs, or other containers well known in the art could be used to contain product. Channels 210*b* and 210*c* of the tri-extruded hose 210 are then connected to the bags 205*a* and 206*a*, which is well known in the art. The product hoses 222*b* and 222*c* interconnect the tri-extruded hose 210 to the flexible product bags 205*a* and 206*a* using barbed fittings 221*b* and 221*c*, respectively. A schematic representation of this is shown in FIG. 7 and an exploded view of this is shown in FIG. 8. One method that may be used is to mount the hose fitting K to the railing 211.

Railing 211 is operatively connected to base 201 proximate the center of base 201 and extends upward to provide support for reel support member 207. Hose reel 204 is operatively connected to railing 211 via reel support member 207 proximate the center of base 201 with nuts and bolts. Hose reel 204 and reel support member 207 are of the type generally known in the art. Hose 209 is operatively connected to hose reel 204, and an extension hose 209*a* connects hose 209 to hose fitting K. The tri-extruded supply hose 210 is then connected to the other end of the hose fitting K. The connection of these hoses is well known in the art. The weight of product containers 205 and 206 are counterweighted by the weight of hose reel 204 to balance the cart 200 evenly. Railing 211 also provides a surface on which a triangular shaped gun support 208 may be attached so that gun 100 may be stored on cart 200 when it is not in use. To store the gun 100, the dispensing nozzle portion of gun 100 is inserted into the center of gun support 208. To utilize the gun 100 attached to cart 200, all that is required is the connection of the water hose 209 to a standard water faucet and the attachment of the product to the product containers. The dispensing and rinsing gun 100 is turned off when the selector 156 is positioned between the valves, as discussed above.

The present invention is designed to dispense and meter dilute product at the end of a gun 100. All the controls are mounted on the dispensing and rinsing gun 100 attached to the hose member 210, and these controls regulate the product used and the type of spray used during the rinse position. This allows for one hand adjustable operation of the dispensing and rinsing gun 100, and a one hand operated adjustable rinse mechanism is also built into the gun 100. This eliminates the need for the operator to return to the remotely located control device to switch from one product to another or to a water spray with no product. Therefore, choosing the appropriate nozzle and installing the appropriate dispensing mechanism is not a concern with this invention.

The hose member 210 has two product channels 210*b* and 210*c* and one water channel 210*a* running along its length. Therefore, immediate switching from one position to another is possible without contamination of the outlet hose because residual solutions remaining in the hose member 210 between cleaning steps is eliminated. This is referred to as a closed product system. Because a garden style hose 209 quickly and easily connects the gun 100 to the water source, minimal plumbing is required to operate gun 100 and the minimum installation required reduces the installation costs. Therefore, minimum field service maintenance is required to support the system which also reduces the cost. Also, the present invention contains approved backflow prevention and antisiphon devices acceptable for plumbing codes and no electricity is required to utilize this device.

In operation of the preferred embodiment dispensing and rinsing gun 100, the first channel of the hose member is operatively connected to a water source, the second channel of the hose member is operative connected to a product source, and the third channel of the hose member is operatively connected to another product source. Water flows through the first channel into the water inlet 102*a* and then out of the water outlet 186 of housing unit 167. Once water flows out of water outlet 186, water flows into tenth bore 143 of housing 122. A plurality of push button valves are utilized for product selection, and when a particular button is compressed, an opening is compressed and allows passage through the valve.

If button 155*a* of push button valve 154*a* is compressed, water will flow into fourth bore 132 and out of first bore 126 of housing 122. Then, water will flow into bore 151*a* causing product to flow into inlet port 149*a,* and a diluted product will flow out of bore 153*a* into first cavity 172. Diluted product will then be dispensed from first tube 169, and a spray nozzle 195 is operatively connected to the end of first tube 169 to create a fan type spray of diluted product from first tube 169.

If button 155*b* of push button valve 154*b* is compressed, water will flow into fifth bore 133 and out of second bore 127 of housing 122. Then, water will flow through bore 110 of first segment 107, through bore 119 of second segment 114, and out of opening 117*a* of pistol 117. Then, water will be dispensed from second tube 170, and pin 120 of pistol 117, which is controlled by trigger 103, determines how water is sprayed from second tube 170. Therefore, no separate selector is required to vary the type of spray. The trigger mechanism of varying the type of spray is well known in the art.

If button 155*c* of push button valve 154*c* is compressed, water will flow into sixth bore 134 and out of third bore 128 of housing 122. Then, water will flow into bore 151*b* causing product to flow into inlet port 149*b,* and a diluted product will flow out of bore 153*b* into third cavity 174. Diluted product will then be dispensed from third tube 171, and spray nozzle 194 and screen 213 are operatively connected to the end of third tube 171 to create foaming of the product being dispensed from third tube 171.

In the preferred embodiment gun 100, one product is a degreaser foam product dispensed via standard foaming means and the second product is a sanitizing mist dispensed via a standard fan spray nozzle, as discussed above. The water rinse spray operated by the trigger 103 is variable, as mentioned above. The degreaser foam spray has a field of approximately 6 feet in length and 2 to 3 feet wide, and when screen 180 is used, the screen 180 condenses the flow to approximately ½ foot wide. The sanitizing mist has a field of 6 feet and 3 to 4 feet wide. The variable rinse spray has a field from 3 feet to 10 feet and is variable by pattern and pressure as controlled by trigger 103.

The preferred embodiment includes individual water valves for each of the two products and for the rinse water. The three water valves manifold together to allow the water to be supplied from a single water source. Aspirators are utilized down stream of the water valves to affect product dispensing by the Ventury principle.

The trigger 103 controls the type of spray of rinse water dispensed from second tube 170, and using the trigger 103 can be done with one hand. The rinse water flows into a throttling device, and then throttling of the water is controlled by the trigger 103 on the gun 100. When trigger 103 is pulled toward handle 101, edges 106*a* and 106*b* contact and pull second segment 114 away from second tube 170, thereby effecting throttling of the water flowing therefrom by pulling pistol 117 inward. The water only dispensing mode requires a hydraulic balancing rinse mechanism to reduce the spring force of the rinse trigger 103 and to allow the mechanism to shut off at all pressures. Although the rinse water may be throttled using the trigger 103, the diluted product mixture of product and water is not be similarly throttled because it is dispensed in a wide open, full flow manner.

The present invention is appropriate for many two product systems (i.e. detergent/perfume and detergent/sanitizer), and is appropriate for use on various food service industry items such as processing equipment, floors, walls, table tops. It is recognized that the present invention may be utilized for many multiple product systems and is not limited to use with food service industry items. The present invention may be utilized with one product and water or numerous products and water. It is understood that gun 100 may be easily modified to include fewer or more dispensing tubes and other components to accommodate the desired number of products and water to be used. Gun 100 is durable to withstand an abusive environment such as continual dropping of the mechanism on quarry tile or concrete floors. Also, gun 100 is relatively small and light weight if pulled or carried, and it is easily movable if on a cart unit 200. In addition, gun 100 possesses self evident or minimal operational instructions and is therefore easy to use. This is partly due to the fact that all required parts and components are attached to or self contained within gun 100.

There are also other configurations of the product supply that could be used to eliminate the need for the cart 200 and the tri-extruded supply hose 210. For example, a small capsule containing product that attaches directly to the dispensing and rinsing gun 100 could be used. This capsule would be small enough to not adversely affect the weight of the gun 100 but large enough to provide product for one to two cleaning applications. When the capsule is empty, the capsule could be easily refilled and replaced or thrown away. These capsules would have shape lock outs or some other means to prevent the wrong product from being dispensed in the gun 100. This configuration would not need the tri-extruded supply hose 210 or the cart 200. It would only require a water hose.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A dispensing gun for dispensing water received from a water supply and for dispensing a product diluted in the dispensing gun with water received from the water supply, comprising:

a. a hose member, said hose member including a first channel and a second channel;

b. a dispensing gun including a handle, said gun including a water inlet, a water outlet, and a hose receiving member operatively connected to said first channel of said hose member, said first channel in fluid communication with said water inlet, said gun receiving a water supply via said first channel of said hose member;

c. an aspirator operatively connected to said second channel of said hose member and in fluid communication with said water outlet, said aspirator having an outlet;

d. a product supply supplying said gun with product via said second channel of said hose member, wherein said aspirator creates a use solution of product diluted with water from said water outlet, said use solution exiting the outlet of the aspirator;

e. a first nozzle operatively connected to said water outlet to dispense water from said water outlet; and f. a first valve in fluid communication with said water outlet and said first nozzle and a second valve in fluid communication with said water outlet and said aspirator, said first valve controlling flow of water via said first channel and said second valve controlling flow of water via said first channel through said aspirator, wherein said first valve allows water to flow from said water outlet through said first nozzle, and wherein said second valve allows water to flow from said water outlet into said aspirator and said use solution created therein to flow through said outlet of said aspirator.

2. The dispensing gun of claim 1, further comprising a cart, said cart including a holder for said gun and a product container.

3. The dispensing gun of claim 2, further comprising wheels on said cart, wherein said cart may be rolled to a desired location.

4. The dispensing gun of claim 1, wherein said hose member is an extruded hose capable of transporting water and product simultaneously.

5. The dispensing gun of claim 1, further comprising a trigger, wherein said trigger controls and adjusts how water spray s from said first nozzle of said dispensing gun.

6. The dispensing gun of claim 1, further comprising a selector operatively connected to said dispensing gun proximate said first valve and said second valve, said selector switching between said first valve and said second valve thereby controlling water flow and use solution flow through said dispensing gun.

7. The dispensing gun of claim 1, further comprising a third channel of said hose member, a second aspirator operatively connected to said third channel of said hose member and in fluid communication with said water outlet, said second aspirator having an outlet, a second product supply supplying said dispensing gun with a second product via said third channel of said hose member wherein said second aspirator creates a use solution of second product diluted with water from said water outlet, a third valve interconnecting said water outlet and said second aspirator for controlling water via said first channel and product via said third channel, said use solution is dispensed from said outlet of said second aspirator, wherein said third valve allows water to flow from said water outlet into said second aspirator and said use solution created therein to flow through said outlet of said second aspirator.

8. An apparatus for dispensing liquid diluent and a liquid concentrate diluted with diluent, comprising:

a. a dispenser including an inlet and an outlet;

b. a hose member including a first channel and a second channel, said first channel interconnecting a liquid diluent source to said inlet, wherein liquid diluent flows from said liquid diluent source into said inlet and out of said outlet;

c. an aspirator operatively connected to said outlet via said second channel, said aspirator having a liquid diluent inlet, a liquid concentrate inlet, and a dilute solution outlet;

d. a control device operatively connected to the aspirator for controlling flow of liquid diluent from a source of liquid diluent to the liquid diluent inlet;

e. a nozzle operatively connected to the outlet for dispensing liquid diluent from the outlet;

f. a first valve in fluid communication with said outlet and said nozzle for controlling flow of liquid diluent through the nozzle; and g. a second valve in fluid communication with said outlet and said aspirator for controlling flow of dilute solution through the dilute solution outlet.

9. The apparatus of claim 8, further comprising a cart, said cart including a holder for said gun and a product container.

10. The apparatus of claim 9, further comprising wheels on said cart, wherein said cart may be rolled to a desired location.

11. The apparatus of claim 8, wherein said hose member is an extruded hose capable of transporting liquid diluent and liquid concentrate.

12. The apparatus of claim 8, further comprising a trigger, wherein said trigger controls and adjusts how liquid diluent sprays from said nozzle of said dispensing gun.

13. The apparatus of claim 8, further comprising a third channel of said hose member, a second aspirator operatively connected to said third channel of said hose member and in fluid communication with said outlet, said second aspirator having a dilute solution outlet, a second liquid concentrate connected to said third channel of said hose member wherein said second aspirator creates a use solution of second liquid concentrate diluted with liquid diluent from said outlet, a third valve in fluid communication with said outlet and said second aspirator for controlling the flow of liquid diluent via said first channel and liquid concentrate via said third channel, wherein said third valve allows liquid diluent to flow from said outlet into said second aspirator and said dilute solution created therein to flow through said dilute solution outlet.

14. A dispensing gun for dispensing water received from a water supply and for dispensing a product diluted in the dispensing gun with water received from the water supply, comprising:

a. a hose member, said hose member including a first channel;

b. a dispensing gun including a handle, said gun including a water inlet, a water outlet, and a hose receiving member operatively connected to said first channel of said hose member, said first channel in fluid communication with said water inlet, said gun receiving a water supply via said first channel of said hose member;

c. an aspirator in fluid communication with said water outlet, said aspirator having an outlet, d. a product supply in fluid communication with said aspirator, wherein said aspirator creates a use solution of product diluted with water from said water outlet, said use solution exiting the outlet of the aspirator;

e. a first nozzle operatively connected to said water outlet to dispense water from said water outlet; and f. a first valve in fluid communication with said water outlet and said first nozzle and a second valve in fluid communication with said water outlet and said aspirator, said first valve controlling flow of water via said first channel and said second valve controlling flow of water via said first channel through said aspirator, wherein said first valve allows water to flow from said water outlet through said first nozzle, and wherein said second valve allows water to flow from said water outlet into said aspirator and said use solution created therein to flow through said outlet of said aspirator.

15. The dispensing gun of claim 14, wherein said hose member has a second channel to place said product supply in fluid communication with said aspirator.

16. The dispensing gun of claim 14, further comprising a third valve and a second product supply in fluid communication with a second aspirator, said second aspirator being in fluid communication with said water outlet and having an outlet, wherein said second aspirator creates a use solution of said second product supply diluted with water from said water outlet, said third valve interconnecting said water outlet and said second aspirator for controlling water via said first channel and second product, said use solution is dispensed from said outlet of said second aspirator, wherein said third valve allows water to flow from said water outlet into said second aspirator and said use solution created therein to flow through said outlet of said second aspirator.

* * * * *